US005201073A

United States Patent [19]

Spanier

[11] Patent Number: 5,201,073

[45] Date of Patent: Apr. 13, 1993

[54] COMBINATION BIB AND DOLL WITH STORAGE POCKET

[75] Inventor: Marilyn S. Spanier, 301 E. 76 St., (#4), New York City, N.Y. 10021

[73] Assignee: Marilyn Spanier, New York, N.Y.

[21] Appl. No.: 696,065

[22] Filed: May 6, 1991

[51] Int. Cl.[5] ..... A41B 13/10; A41B 27/20

[52] U.S. Cl. ..... 3/49 R; 2/75; 2/247; 446/28

[58] Field of Search ..... 2/46, 48, 49 R, 75, 2/80, 104, 94, 247, 249, 253; 446/26, 27, 28

[56] References Cited

U.S. PATENT DOCUMENTS

| | | | |
|---|---|---|---|
| D. 62,270 | 5/1923 | Bensen | D2/228 |
| D. 72,655 | 5/1927 | Bowman | D2/228 |
| D. 290,421 | 6/1987 | McNally et al. | D2/228 |
| 1,123,539 | 1/1915 | Inke | 2/253 |
| 1,212,639 | 1/1917 | Hester | 2/253 |
| 1,685,243 | 9/1928 | Rich | 2/94 X |
| 1,839,261 | 7/1932 | Jennings | 2/94 |
| 1,926,866 | 9/1933 | Doniger | 2/253 |
| 2,883,673 | 4/1959 | Solomon | 2/253 |
| 3,624,686 | 11/1971 | Beals | 2/247 |
| 3,840,901 | 10/1974 | Eyster | 2/247 |
| 4,197,670 | 4/1980 | Cox | 46/153 |
| 4,218,781 | 8/1980 | Lieberman | 2/247 |
| 4,404,687 | 9/1983 | Hager | 2/94 |
| 4,543,669 | 10/1985 | Katz | 2/84 |
| 4,637,075 | 1/1987 | Ingrisano et al. | 2/94 |
| 4,660,225 | 4/1987 | Kahn | 2/49 R |
| 4,663,779 | 5/1987 | Bible | 2/49 R |
| 4,710,979 | 12/1987 | Bull et al. | 2/48 |
| 4,791,681 | 12/1988 | Dean | 2/253 |
| 4,829,601 | 5/1989 | Spanier | 2/49 R |
| 4,924,528 | 5/1990 | Trombetti-Dickens | 2/104 |
| 4,949,401 | 8/1990 | Kimsey, Jr. | 2/94 |

FOREIGN PATENT DOCUMENTS

| | | | |
|---|---|---|---|
| 1235435 | 5/1960 | France | 2/253 |
| 229950 | 3/1925 | United Kingdom | 2/253 |

*Primary Examiner*—Clifford D. Crowder
*Assistant Examiner*—Jeanette Chapman

[57] ABSTRACT

A combination bib and toy with storage pocket which is comprised of any suitable material. The toy may comprise a doll in the form of a female or male human figure or it may take the form of an animal figure such as a dog. The combination with storage pocket has a holder hidden within the storage pocket for removably attaching an item, such as, a rattle or squeaky toy. The novel storage pocket is made of any suitable material and it is attached to the back portion of the bib body, thus giving the combination bib and toy more three dimensional appeal when the novel storage pocket is filled with children's items. Attached, by any means, to the hands of the combination bib and toy with storage pocket is an attaching means made of any suitable material, for removably attaching said hands to each other or for removably attaching any such holder means for holding a pacifier or small toy.

1 Claim, 4 Drawing Sheets

COMBINATION BIB AND DOLL WITH STORAGE POCKET

BACKGROUND OF THE INVENTION

1. Field of the Invention

This invention relates generally to protective coverings for clothing such as bibs and more particularly to a combination bib and doll or bib and toy in animal-form each having a storage pocket and a hidden holder for a rattle or squeaky toy.

2. Description of Prior Art

No bibs up until now have had an attached storage pocket for storing a diaper, underwear, non-bulky change of clothing or other such small and lightweight item(s) for the child. These combination bib and dolls or bib and toys in animal-form, each with a storage pocket that is located on the back portion of the bib body, not only protect the clothing that the child is wearing while feeding, but also provide a novel and useful storage pocket. In addition, this improved invention enhances the child's play, while the child plays with his or her combination bib and doll or bib and toy in animal-form, which now has a more three dimensional appeal because of its stuffed body portion due to the diaper, underwear, non-bulky change of clothing or other such small and lightweight children's item(s) that are stored in the new storage pocket. It also enables the adult caring for the child to have a novel and very necessary and useful storage area. Adults have always lacked places to store the numerous child's items needed to be carried around while caring for the child. Adults fill to capacity all known storage areas. Simply put, adults lack new and useful areas for such storage. This, however, is an unknown need. No one up until now has discovered the solution to this unknown need. However, I have discovered the solution to this unknown need with my new and improved invention. No one up until now has ever conceived of this wonderful solution to this unknown need. One reason for this is that bibs are not thought of as places to store other items. Bibs are by definition, "a cloth or plastic shield tied under a child's chin to protect the clothes". There are some bibs, that have a small cavity made to remain in an open position, on the bottom portion of the front part of said bibs. These bibs are merely meant to catch food that spills downward, keeping in tradition with the general purpose of bibs, that being to protect the child's clothes while feeding. Two examples of bibs that contain such small cavities just for the purpose of catching food that falls, are the Quilling et al. U.S. Pat. No. 4,660,226 and the Bible U.S. Pat. No. 4,663,779. Even though bibs have never before been thought of as the type of item that could be made in combination with a storage pocket for storing some children's items, the definition and purpose of bibs should now be expanded, because of my invention, to include such a useful improvement. My U.S. Pat. No. 4,829,601, is a combination bib and doll with three dimensional facial features, and depending arms and legs. The bib and animal combination also has a depending tail and ears. The depending arms, legs, tail and ears are of sufficient length and density to enable the child to easily grasp. This bib and doll combination serves the purpose of both a bib and a doll. Excitingly enough, this new and improved invention with a storage pocket, not only provides a wonderfully new, novel, and useful storage area, but when it is filled with the child's items, the body of the bib is now wonderfully full and three dimensional, unlike the fairly flat body of the bib in my U.S. Pat. No. 4,829,601. In my current invention, each member of the combination bib and doll with storage pocket function together harmoniously, and for the benefit of the invention's integrality. No bibs up until now have had a hidden, removably attaching holder for a small item, such as, a rattle or squeaky toy, enabling the adult to remove the small item when damaged or when the bib is in need of laundering.

SUMMARY OF THE INVENTION

This invention is an improved, reusable bib which comprises a bib and doll or a bib and toy in animal-form with a storage pocket for storing children's items, such as, diapers, non-bulky clothing, underwear or any other such small and lightweight item(s) for the child. This storage pocket is located on the back portion of the bib body. This improved invention also includes a hidden, removably attaching holder for a small item, such as, a rattle or squeaky toy. Adults have always lacked places to store the numerous items needed to be carried around while caring for a child. Aside from bottles, toys, bibs, pacifiers, and washcloths, adults carry around diapers, underwear, and non-bulky changes of clothing. The adults fill to capacity their carriage storage areas, their baby accessory bags, their own pockets and their pocket books. Simply put, adults require more storage areas for children's items. Adults presently lack new and useful areas for such storage. Even though there is a need for new and useful storage space, it is an unknown need, and therefore, the problem of creating new and useful storage space for small and lightweight children's items has not been solved up until now. The problem, however, is now solved by my new and improved bib which has its own storage pocket on the back body portion of both the combination bib and doll and the combination bib and toy in animal-form. On the upper interior edge of the outer panel of the storage pocket is a removably attaching fastener to attach the pocket's outer panel to the back portion of the bib body, the pocket's inner panel. Aside from being a necessary storage area, the storage pocket provides heightened stimulation for the child since now not only do the depending arms, legs, ears, and tail of the bib and doll or bib and toy in animal-form give the child a bib that is also a doll or toy in animal-form, but the stuffed storage pocket gives the body portion of the combination bib and doll or bib and toy in animal-form a new three dimensional appeal. Aside from storing a diaper, underwear, non-bulky change of clothing, or other small and lightweight item(s), there is also a removably attaching holder for an item, such as, a rattle or squeaky toy, that is removably attached to the back portion of the bib body and hidden within the storage pocket. This enables the child to play with the rattle or squeaky toy while it is still inside the pocket of the combination bib and doll or bib and toy in animal-form. This provides a new and useful storage space for an item, such as, a rattle or squeaky toy and also prevents the loss of same. The removably attaching holder enables the adult to remove the rattle or squeaky toy when the rattle or squeaky toy is damaged or when the bib is in need of laundering. This new and improved invention and the child who wears this new and improved bib are best served if the new and inproved invention is comprised of any suitable material, such as, but not limited to, towel material, quilting material, plastic, such as, for example, nylon, polyester, polypropylene or any blend or combination thereof. One reason this new and improved invention needs to be made of varied materils is that the child who is allergic to one particular material would be deprived of this wonderful invention, if it were solely made of that one particular material, since the adult would then not be able to store the child's underwear, diapers or non-bulky change of clothing, in said storage pocket. It therefore best serves the wearer of this new and improved bib and the invention itself if the invention is comprised of, and available in every suitable bib material, so as to enable those allergic to one particular material to enjoy this wonderfully new and improved invention. In addition, bibs are also taken to the beaches, lake areas, or poolside, and therefore some bibs need to be comprised of materials that are water and sand resistant such as, for example, certain plastics. These water and sand resistant materials will keep the items that are stored in the novel storage pocket dry and clean when the combination bib and doll with storage pocket or bib and toy in animal-form with storage pocket are taken to such beach, lake, or poolside areas, since children will be so very fond of their combination bib and doll or bib and toy in animal-form, that they will want to take it with them wherever they go. Also, since children may have a favorite female character, male character, animal character, or several favorite characters, it is also vitally important to have diverse female characters, male characters, or animal characters available in the combination bib and doll with storage pocket or in the combination bib and toy in animal-form with storage pocket. The characters in the combination bib and dolls with storage pocket could be in the embodiment of human, ficticious, or mythical male and female dolls, and the characters in the combination bib and toy in animal-form with storage pocket could be in the embodiment of animal-forms resembling those in the animal kingdom, ficticious, or mythical animal-form toys. If children have the opportunity to choose the female, male, or animal-form they prefer, this action, in itself will also assist the children with their cognitive development, with their sense of reasoning, and it will also assist them with their sense of self and self worth, and this is vitally important.

An object of the invention is to provide a reusable bib, comprised of any suitable material, that can be conveniently carried around anywhere, by the child, and which can be used as either a bib, a doll, a toy, a necessary storage space, or all of the above, working harmoniously together, as one unit, in combination.

DESCRIPTION OF THE PREFERRED EMBODIMENTS

Throughout the following description reference will be made to the drawings. Identical numerals will be used throughout the several views to indicate the same or like parts of the invention. The invention's structure and use will be discussed.

A toy may be described as a doll in the form of a female or male human figure or it may be described as an animal figure such as a dog as described in my earlier U.S. Pat. No. 4,829,601. The figures include a body and a pair of arms, legs and hands. The variation of forms may be described as a combination bib and doll or a combination bib and toy in animal form; however, it is understood that the disclosure of the combination bib and toy alone may be employed to include and to describe either or both the human figures and the animal forms.

Figure 2:
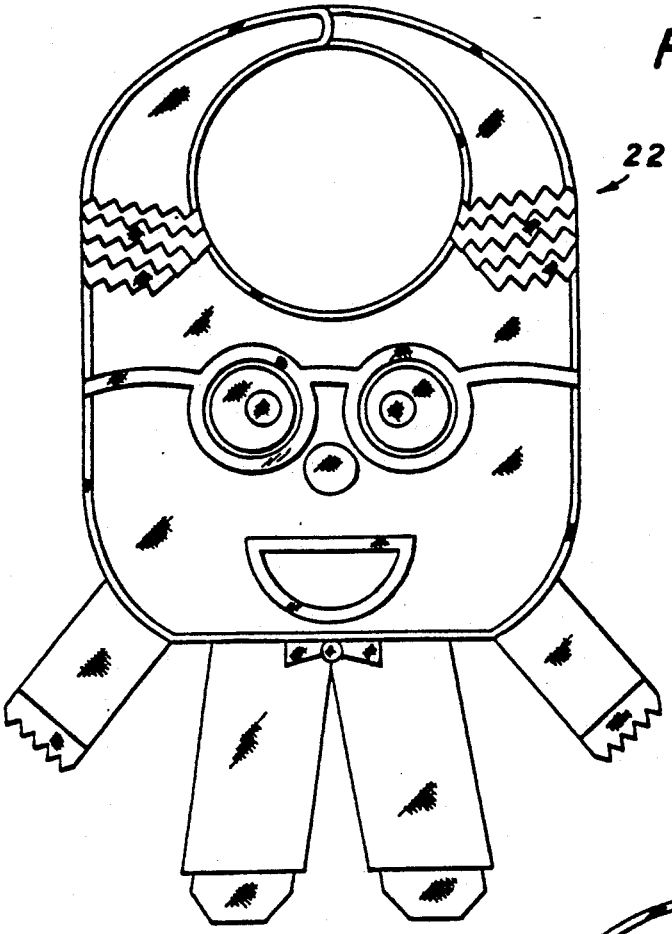
FIG. 2 is a front plan view showing the invention in the embodiment of a male.
Figure 3:
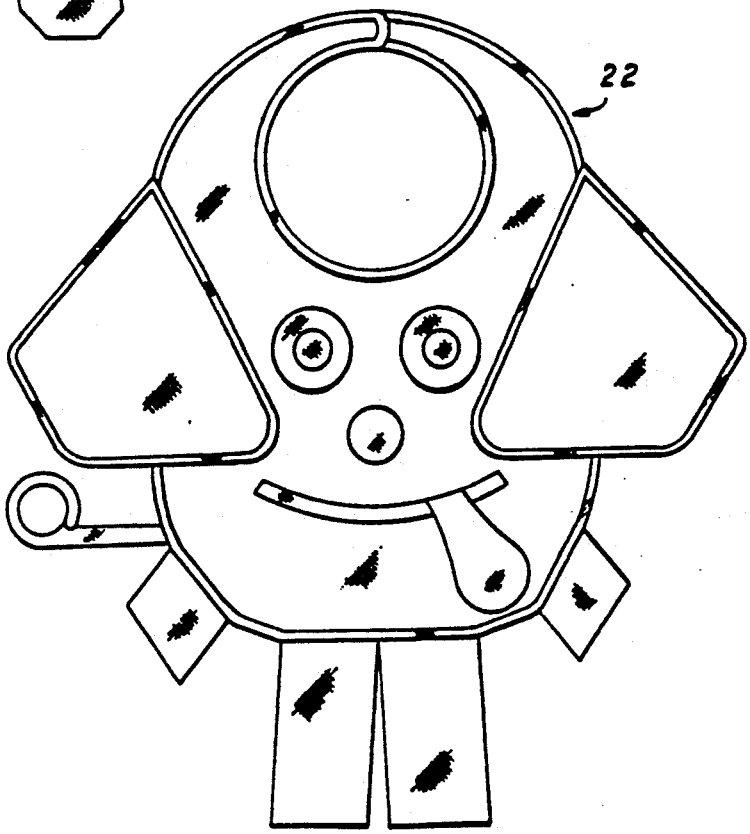
FIG. 3 is a front plan view showing the invention in the embodiment of an animal.
Figure 4:
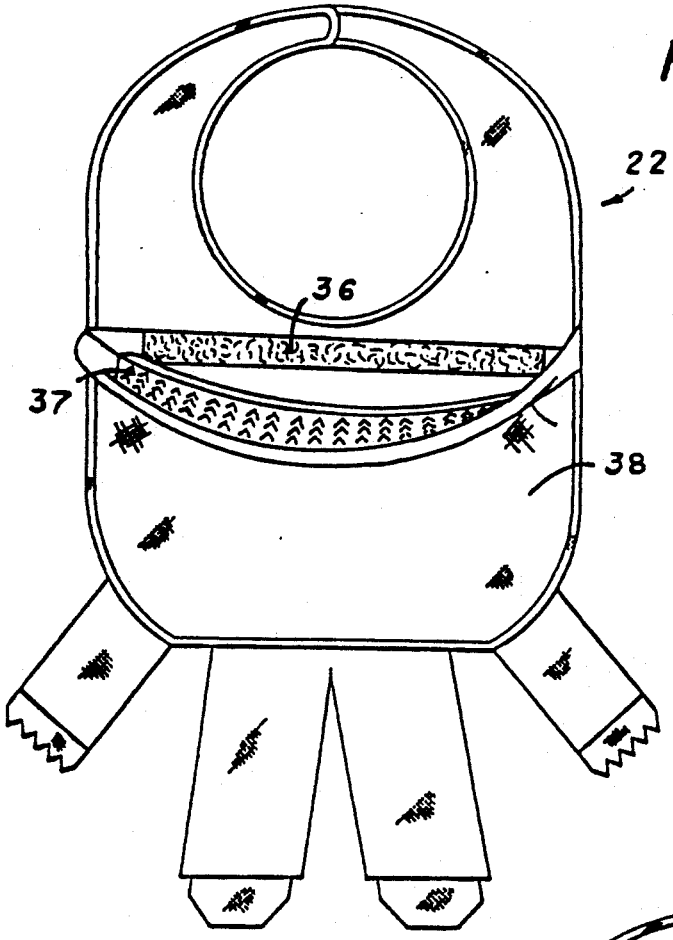
FIG. 4 is a back plan view of the invention showing the storage pocket, the folded over top edge of the outer panel of said storage pocket, the 1st attaching means on the upper interior edge of said storage pocket's outer panel and the 2nd attaching means on the top of the bib body.
Figure 5:
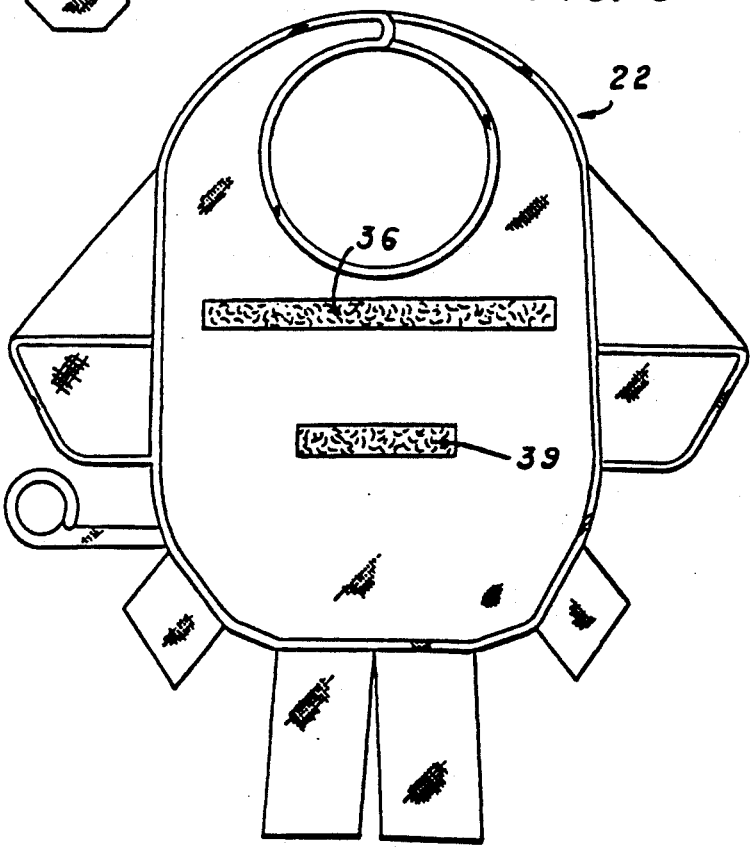
FIG. 5 is a back plan view of the invention, shown here without the storage pocket's outer panel, to show the 2nd attaching means on the bib body that attaches to the storage pocket's outer panel's upper interior edge and also to show the fourth attaching means on the bib body to attach the holder used for a small item, such as, a rattle or squeaky toy.
Figure 6:
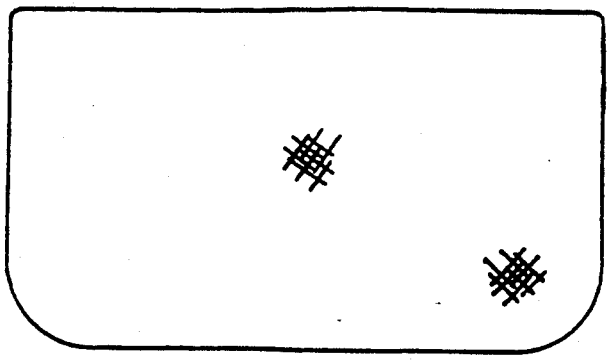
FIG. 6 is the front plan view of the holder used for a small item, such as, a rattle or squeaky toy.
Figure 7:
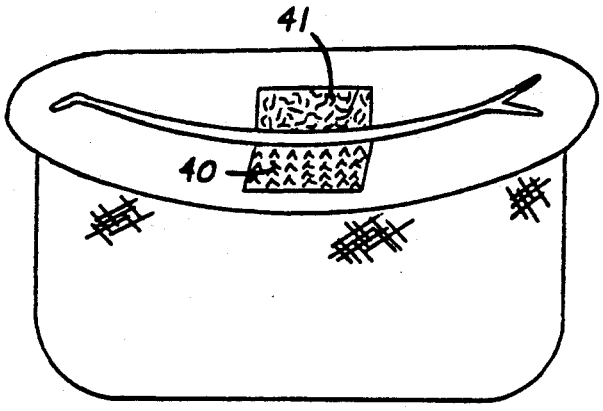
FIG. 7 is the front plan view of the holder, showing said holder, a folded over top edge of the front of said holder, the fifth attaching means on the interior top center edges of each side of said holder.
Figure 8:
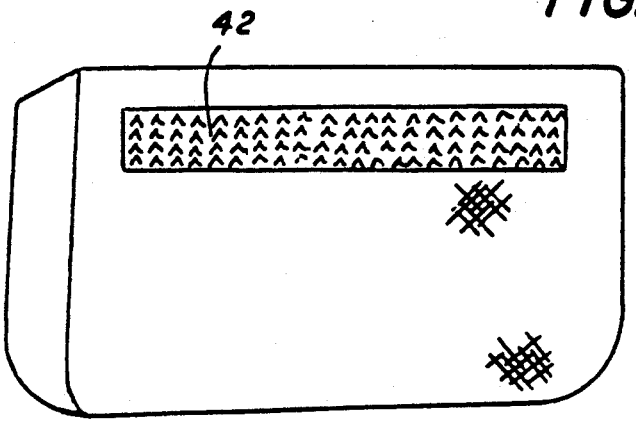
FIG. 8 is the back and side view of the holder showing the third attaching means on the upper back edge of said holder.

Referring now to FIGS. 1 through 5, all materials used in the invention are comprised of any suitable material, such as, but not limited to, towel material, quilting material, plastic, such as, for example, nylon, polyester, polypropylene or any blend or combination thereof. FIG. 4 and FIG. 5, one can clearly see that the preferred embodiment of the pocket is comprised of two separate panels of material, one panel of material, being the portion of the back of the bib body 22, that lies just below the neckline, this being the inner panel of the pocket means, and the other panel of material being the storage pocket's outer panel, 38, as seen in FIG. 4. As is evident in FIG. 4, the novel storage pocket's outer panel 38 is formed by a panel of said material being contoured around and attached by any means, to the back portion of the bib body 22. The storage pocket's outer panel 38 has attached to it, by any means, at its upper interior edge, a 1st attaching means 37, shown in FIG. 4, for removably attaching said pocket's outer panel's upper interior edge from the back portion of the bib body 22. Attached, by any means to the upper edge of the back portion of the bib body 22, just below the neckline as illustrated in FIGS. 4 and 5, is a 2nd attaching means 36. The storage pocket's outer panel's 1st attaching means 37 is illustrated in FIG. 4, by the folded over top edge of the outer panel of said storage pocket. The 1st attaching means 37, attached to the upper interior edge of the storage pocket's outer panel, attaches onto the 2nd attaching means 36 that is attached to the back portion of the bib body, the storage pocket's inner panel, to fasten said storage pocket. The holder means used for holding a small item, such as, a rattle or squeaky toy is represented by FIGS. 6 through 8, inclusive. As evidently noted, FIGS. 5–8, inclusive, represent the different views of the same embodiment of the holder means. As one can clearly see, FIG. 7 and FIG. 8 also show the different attachment means of the holder means. FIG. 6 shows the front plan view of the holder means. FIG. 7 shows the folded over top edge of the front of said holder means, the 5th attaching means 40 and 41 on the interior top center edges of each side of said holder means, for removably attaching each side of said holder means top center edges to each other and FIG. 8 shows the back and side view of the holder means and also shows the 3rd attaching means, 42, on the upper back edge of said holder means. As is apparent in FIG. 7 and FIG. 8, the holder means is comprised of at least front and back panels of material and said holder means is formed when these panels of material are attached together by any means, at edges along three sides of the holder means. Also as is noted in FIG. 7 and FIG. 8, the holder means exists as a structure before the 3rd attaching means, 42, in FIG. 8, attaches onto the 4th attaching means, 39, shown in FIG. 5, to attch the holder means to the back of the body of the bib at its specified location. The holder means is comprised of any suitable material, such as, but not limited to, towel material, quilting material, plastic, such as, for example, nylon, polyester, polypropylene or any blend or combination thereof. The holder means represented by FIGS. 6, FIG. 7 and FIG. 8, is removably attachable, by any means, to the back portion of bib body 22 and is hidden within the storage pocket. At the upper exterior edge of the rear of said holder means is attached, by any means, a 3rd attaching means 42, illustrated in FIG. 8, for removably attaching said holder mean's rear upper exterior edge on the back portion of the bib body 22. The middle section of the back portion of the bib body 22, has attached to it, by any means, a 4th attaching means 39, illustrated in FIG. 5, made of any suitable material, for removably attaching said holder means' rear upper exterior edge to said back portion of the bib body. The hands 24, illustrated in FIG. 1, have a 6th attaching means 43, made of any suitable material, attached by any means, for removably attaching hands to each other or for removably attaching any other such attaching means that can hold a small item, such as, a pacifier or other small toy.

Figure 1:
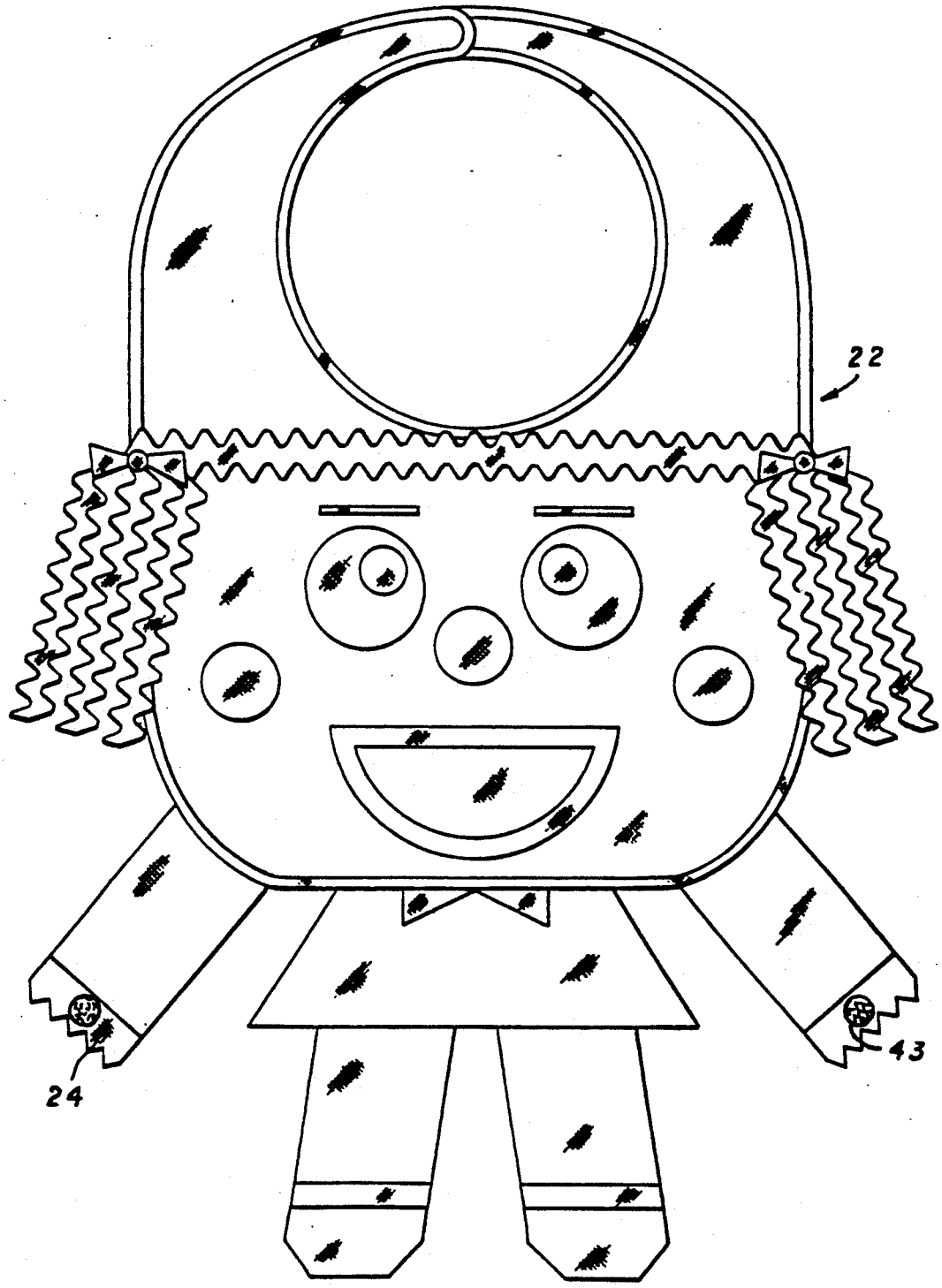
FIG. 1 is a front plan view showing the invention in the embodiment of a female.

FIG. 1 is in the embodiment of a female doll.

FIG. 2 is in the embodiment of a male doll.

FIG. 3 is in the embodiment of a toy in animal-form. The body of bib 22 will keep the child's clothing clean during feeding, while the dolls of the combination bib and dolls of FIGS. 1 and 2 and the toy in animal-form of the combination bib and toy in animal-form of FIG. 3 will keep the child playfully occupied during such feeding. In addition, with this new and improved bib, the storage pocket, illustrated in FIG. 4, when filled with the items it is storing, will give the body of the bib a three dimensional appeal as well, unlike my previous U.S. Pat. No. 4,829,601. In my previous U.S. Pat. No. 4,829,601, although the facial features, the arms, legs, and tail of the invention are three dimensional, the body of the bib is flatter. Please refer to my former U.S. Pat. No. 4,829,601, granted to me on May 16, 1989, if necessary. The addition of the storage pocket, as shown in FIG. 4, in my improved invention was intended to give adults a new, novel, and necessary storage area, while also adding a more three dimensional appeal to the body of the combination bib and dolls and combination bib and toys in animal form of the invention. In addition, the holder FIG. 6, FIG. 7 and FIG. 8 for small items, such as, a rattle or squeaky toy, when filled with such rattle or squeaky toy, makes the bib an even more wonderful three dimensional doll or toy in animal-form, since it also makes rattle-like or squeaky toy noises, adding sound stimulation as well to this combination bib and doll or bib and toy in animal-form. This will stimulate and playfully occupy the child while feeding to make feeding easier and more pleasant for the adult caring for the child as well as for the child. This additional physical and auditory stimulation is achieved by the novel and useful storage pocket illustrated in FIG. 4 and by the holder FIG. 6, FIG. 7 and FIG. 8 that is hidden within said storage. Thus, as one can clearly see, the combination bib and dolls and the combination bib and toys in animal-form, the novel storage pocket, and the holder means act harmoniously together as one unit in combination. The 6th attaching means 43, attached to the hands 24 of the dolls or animals of the invention, illustrated here in FIG. 1, are provided to assist the adult and the child. Any such removably attaching holder means can be removably attached to 6th attaching means 43, for holding an item, such as, a pacifier or small toy. This provides a means for the child to carry said pacifier or small toy, while he wears or plays with the invention, and insures that the child will not lose said pacifier or small toy, since said pacifier or small toy will be held onto the hand of said bib and doll or bib and toy in animal-form combination by the removably attaching holder.

The preferred embodiments of this invention have been set forth in the descriptions and drawings. These descriptions are used in a generic sense only and not for purposes of limitation. Various modifications may therefore be made therein without departing from the spirit and scope of the invention.

Having thus fully described my invention, what I claim as new and useful and desire to secure by letters patent is:

1. A combination bib and toy wherein the bib is configured in the shape of a toy having a body and a pair of arms, legs and hands, said combination providing a bib to protect a child while also providing an amusement device for the child, the improvement comprising:

a pocket means having a panel attached to a back of said body portion of said bib, said panel forming an outer panel for said pocket means and said back of said body portion of said bib forming an inner panel of said pocket means;

a first attaching means attached to an upper interior edge of said outer panel;

a second attaching means attached to an upper section of said back of said body portion of said bib for removably attaching said upper interior edge of said outer panel to said upper section of said back of said body portion of said bib to close and open said pocket means; and when said pocket means is filled with diapers and clothes, the bib and toy combination assumes a three dimensional form;

a holder means formed from at least front and back panels attached to each other;

a third attaching means attached to an exterior upper edge of a back of said holder means;

a fourth attaching means attached to a middle section of said back of said body portion of said bib for removably attaching said back of said holder means to said middle section of said back of said body portion of said bib; wherein said holder means is hidden in the pocket means when attached to said bib;

a fifth attaching means attached to the interior top center edges of each panel of said holder means for removably attaching said interior top center edges together to open and to close said holder means;

a sixth attaching means attached to said pair of hands for removably attaching the hands to each other and for alternatively attaching said holder means to either hand of said pair of hands.

* * * * *